US009152123B2

(12) United States Patent
Park et al.

(10) Patent No.: US 9,152,123 B2
(45) Date of Patent: Oct. 6, 2015

(54) DEVICE FOR REMOVING JAM, IMAGE FORMING APPARATUS INCLUDING THE SAME, AND METHOD OF REMOVING JAM

(71) Applicant: SAMSUNG ELECTRONICS CO., LTD., Suwon (KR)

(72) Inventors: Jeong-yeon Park, Hwaseong (KR); Byung-sun Ahn, Suwon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/953,154

(22) Filed: Jul. 29, 2013

(65) Prior Publication Data

US 2014/0161488 A1 Jun. 12, 2014

(30) Foreign Application Priority Data

Dec. 12, 2012 (KR) ..... 10-2012-0144674

(51) Int. Cl.
*G03G 21/00* (2006.01)
*G03G 21/16* (2006.01)

(52) U.S. Cl.
CPC ..... *G03G 21/1638* (2013.01); *G03G 2221/169* (2013.01); *G03G 2221/1684* (2013.01)

(58) Field of Classification Search
CPC ..... G03G 21/1638; G03G 21/1623; G03G 21/1633; G03G 2221/1675
USPC ..... 399/124
See application file for complete search history.

(56) References Cited

U.S. PATENT DOCUMENTS

| | | | |
|---|---|---|---|
| 2005/0281579 | A1* | 12/2005 | Umeda et al. |
| 2006/0051127 | A1* | 3/2006 | Kang et al. |
| 2006/0140673 | A1* | 6/2006 | Kamimura et al. |
| 2006/0140674 | A1* | 6/2006 | Sato |
| 2007/0160380 | A1* | 7/2007 | Imaizumi et al. |
| 2007/0160384 | A1* | 7/2007 | Sakurai et al. |
| 2007/0160385 | A1* | 7/2007 | Noguchi et al. |
| 2008/0292355 | A1* | 11/2008 | Sakurai et al. |
| 2010/0080614 | A1 | 4/2010 | Yamaguchi et al. |
| 2010/0080617 | A1* | 4/2010 | Noguchi |
| 2010/0080627 | A1 | 4/2010 | Takamura |
| 2011/0293324 | A1* | 12/2011 | Hoashi |
| 2012/0003005 | A1 | 1/2012 | Nishiuwatoko |

FOREIGN PATENT DOCUMENTS

JP 2007033638 A * 2/2007

* cited by examiner

*Primary Examiner* — Walter L Lindsay, Jr.
*Assistant Examiner* — Milton Gonzalez
(74) *Attorney, Agent, or Firm* — Staas & Halsey LLP

(57) ABSTRACT

A jam removing device, an apparatus including a jam removing device, and a method of removing a jam are provided. The jam removing device includes a first door member installed on an in/out path of a tray mounted with a developing unit and is opened or closed with respect to an apparatus body, a second door member installed in the apparatus body in an opposite direction to the first door member and is opened or closed with respect to the apparatus body, a guide unit including a first guide that guides insertion/withdrawal of the tray with respect to the apparatus body and a second guide that guides the first guide so that the developing unit approaches or separates from a transfer unit, a first link unit connecting the first door member and the first guide, and a second link unit connecting the second door member and the first guide.

19 Claims, 5 Drawing Sheets

DEVICE FOR REMOVING JAM, IMAGE FORMING APPARATUS INCLUDING THE SAME, AND METHOD OF REMOVING JAM

CROSS-REFERENCE TO RELATED APPLICATIONS

This application is related to, and claims priority to, Korean Patent Application No. 10-2012-0144674, filed on Dec. 12, 2012, in the Korean Intellectual Property Office, the disclosure of which is incorporated herein in by reference.

BACKGROUND

1. Field

Exemplary embodiments of the present invention relate to a jam removing device, an image forming apparatus including the jam removing device, and a method of removing a jam, and more particularly, to a jam removing device whereby a jam may be easily removed if a jam occurs in an image forming operation, an image forming apparatus including the jam removing device, and a method of removing a jam.

2. Description of the Related Art

An image forming apparatus radiates modulated light on a photoconductor in response to image information so as to form an electrostatic latent image on a surface of the photoconductor, and supplies toner to the electrostatic latent image so as to form a visible toner image on the surface of the photoconductor. After transferring the visible image to a recording medium, printing may be performed by a fixing scheme using heat and pressure.

In a process of performing a printing using the image forming apparatus, the recording medium may become stuck in the apparatus, that is, a jam may occur, due to various reasons such as a state of the recording medium, wear of the internal components of the image forming apparatus, etc. When such a jam occurs, the stuck recording medium needs to be removed.

If a recording medium is stuck between a developing unit and a transfer unit, as the developing unit and the transfer unit are in contact, the recording medium may be torn when removing the recording medium, and thus it may be difficult to completely remove the recording medium. The transfer unit or the developing unit may be damaged due to friction with the recording medium. Accordingly, a printing operation may become inaccurate or even impossible to perform.

SUMMARY

Additional aspects and/or advantages will be set forth in part in the description which follows and, in part, will be apparent from the description, or may be learned by practice of the invention.

An exemplary embodiment of the present invention provides a jam removing device capable of easily removing a recording medium that is stuck between a transfer unit and a developing unit from two sides of an apparatus body.

An exemplary embodiment of the present invention provides an image forming apparatus including the jam removing device, and a method of removing a jam.

According to an aspect of the present invention, a jam removing device is provided including a first door member that is installed on an in/out path of a tray mounted with a developing unit and is opened or closed with respect to an apparatus body, a second door member that is installed in the apparatus body in an opposite direction to the first door member and is opened or closed with respect to the apparatus body, a guide unit comprising a first guide that guides insertion/withdrawal of the tray with respect to the apparatus body and a second guide that guides the first guide in such a manner that the developing unit approaches or separates from a transfer unit, a first link unit connecting the first door member and the first guide, and a second link unit connecting the second door member and the first guide.

When the first door member is opened or closed, the first guide may be guided by the second guide to move in a direction where the developing unit approaches or separates from the transfer unit.

When the second door member is opened or closed, the first guide may be guided by the second guide to move in a direction where the developing unit approaches or separates from the transfer unit.

The first link unit and the second link unit each may comprise an elastic body that is stretchable/contractible in a length direction.

When one door member of the first and second door members is opened, a corresponding link unit from among the first and second link units that connects the other door member of the first and second door members, which is not opened, and the first guide may be stretched or contracted.

When one door member of the first and second door members is opened, a corresponding link unit from among the first and second link units that connects the one door member of the first and second door members, which is opened, and the first guide may be stretched.

One of the first guide and the second guide may comprise a protruded boss, and the other of the first guide and the second guide may include a long hole, into which the boss is inserted, so as to guide the boss.

The long hole may comprise a contact portion to allow the developing unit to contact the transfer unit, a first separation portion that is extended from the contact portion and via which the developing unit is separated from the transfer unit, and a second separation portion that is extended from the contact portion in an opposite direction to the first separation portion and via which the developing unit is separated from the transfer unit.

When the first door member is opened, the boss may be located at the first separation portion.

The second door member is opened, the boss may be located the second separation portion.

When the first door member or the second door member is closed, the boss may be located at the contact portion.

According to an aspect of the present invention, there is provided an image forming apparatus in which a developing unit for forming a visible image is detachably coupled to an apparatus body, comprising: a tray that is mounted with the developing unit and is installed in a manner that the tray may enter and exit the apparatus body, a transfer unit transferring a visible image formed by using the developing unit to a recording medium, and a jam removing device described above.

According to an aspect of the present invention, a method of removing a jam is provided, the method comprising preparing a jam removing device comprising first and second door members that are installed respectively at each of two sides of an apparatus body to open or close the apparatus body, a first guide guiding insertion and withdrawal of a tray mounted with a developing unit, a second guide guiding the first guide to separate from the transfer unit, and first and second link units respectively connecting the first and second door members and the first guide, moving the first guide along the second guide by opening the first door member, separating the tray from the transfer unit by using the first guide, and separating the developing unit from the transfer unit.

The method may further comprise: moving the first guide along the second guide by opening the second door member, separating the tray from the transfer unit by using the first guide, and separating the developing unit from the transfer unit.

The tray may be drawn from the apparatus body while the first door member is opened.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

The present invention is described with reference to the accompanying drawings, in which exemplary embodiments of the present invention are shown. For clarity of description of the features of the exemplary embodiments of the present invention, details that are well-known to one of ordinary skill in the art will be omitted.

Figure 1:
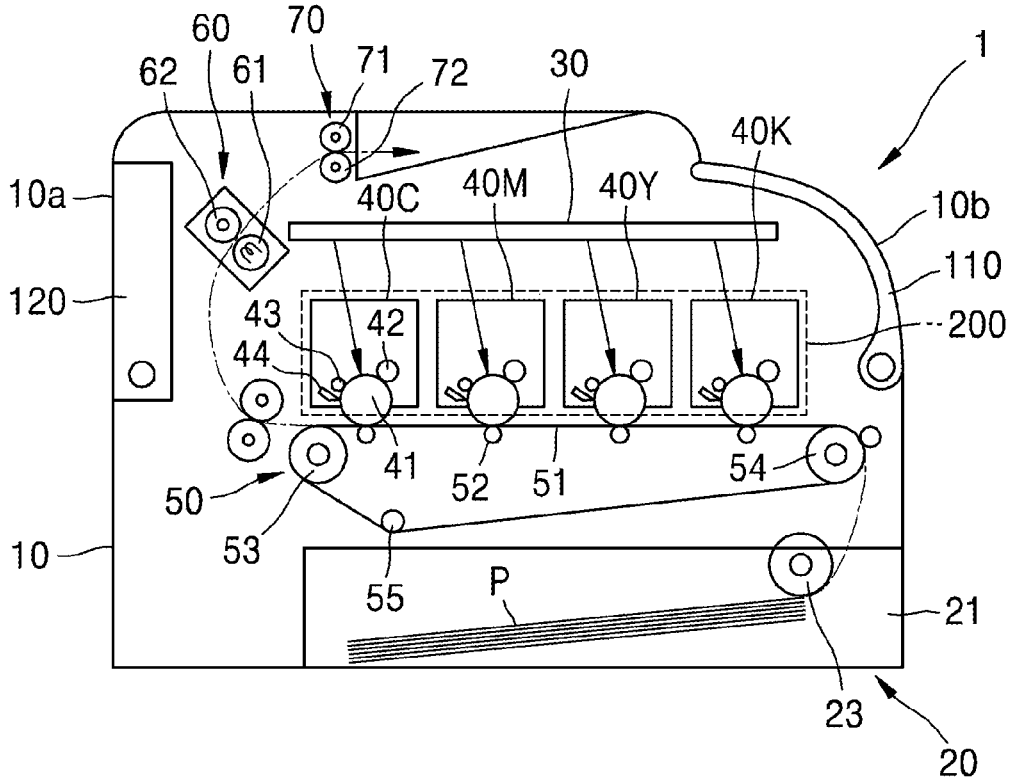
FIG. 1 illustrates an image forming apparatus according to an exemplary embodiment of the present invention.

FIG. 1 illustrates an image forming apparatus 1 according to an exemplary embodiment of the present invention.

Referring to FIG. 1, the image forming apparatus 1 according to an exemplary embodiment of the present invention may include an apparatus body 10, a paper feeding unit 20, a laser scanning unit 30, a developing unit 40C, 40M, 40Y, 40K (hereinafter referred to as a developing unit 40), a transfer unit 50, a fusing unit 60, and a discharging unit 70.

The apparatus body 10 may form an overall external appearance of the image forming apparatus 1 and support various components mounted therein. A first door member 110 and a second door member 120, which may be opened or closed with respect to the apparatus body 10, may be respectively installed, for example, at each of two sides of the apparatus body 10.

The paper feeding unit 20 supplies a recording medium P to the developing unit 40. The paper feeding unit 20 includes a cassette 21, which is detachably mounted on the apparatus body 10. The recording medium P is loaded on the cassette 21, and when printing is performed, sheets of recording media P loaded on the cassette 21 are picked up one-by-one by a pickup roller 23. A recording medium P picked up by the pickup roller 23 is transported in the direction of the transfer unit 50 and the developing unit 40.

The light scanning unit 30 radiates light corresponding to image information input from the outside to a photoconductor 41 so as to form an electrostatic latent image on a surface of the photoconductor 41. In the case of a color image forming apparatus as the image forming apparatus 1 in FIG. 1, the light scanning unit 30 may be configured to radiate light corresponding to yellow Y, magenta M, cyan C, and black K to the photoconductor 41.

The developing unit 40 may include four developing units 40 containing yellow Y, magenta M, cyan C, and black K developers, respectively. Each developing unit 40 may include a photoconductor 41, a charge roller 43 for charging the photoconductor 41, a developing roller 42 for forming a visible image by supplying developers to an electrostatic latent image formed on the photoconductor 41, and a cleaning member 44 for removing developers remaining on a photoconductor after a transfer operation. The colors of the toners contained in the developing units 40 are different, but each developing unit 40 may have the same configuration. Though not illustrated in the drawings, the developing unit 40 may include a plurality of electrical contacts (not shown) for applying a voltage to each of the photoconductor 41, the charge roller 43, the developing roller 42, and the cleaning member 44.

When the developers included inside the developing unit 40 are consumed, the developing unit 40 may be substituted by a new developing unit 40. The developing unit 40 may be mounted on a tray 200 that may be installed in a manner that the tray 200 may enter and exit the apparatus body 10. A plurality of developing units 40 may be inserted at one time by inserting the developing units 40 into the apparatus body 10 through the tray 200. The tray 200 may be drawn out from the apparatus body 10 after opening the first door member 110 that is installed on an in/out path of the tray 200.

The transfer unit 50 transfers the visible image formed on the surface of the photoconductor 41 to the recording medium P. The transfer unit 50 may include a conveyance belt 51 for conveying the recording medium P and transfer rollers 52 for transferring a visible image formed on the surface of each photoconductor 41 to the recording medium P conveyed to the conveyance belt 51. The conveyance belt 51 may be rotated in a state in which a predetermined tension exists using a driving roller 53, a tension roller 55, and a passivity roller 54. The conveyance belt 51 may be a paper transfer belt (PTB) for directly transferring the visible image formed on the photoconductor 41 to the recording medium P. A voltage having a polarity opposite to that of the developer attached on each photoconductor 41 may be applied to the transfer roller 52. A visible image formed on the photoconductor 41 may be transferred to the recording medium P moved by the conveyance belt 51.

The fusing unit 60 includes a heating portion 61 and a pressure roller 62. The fusing unit 60 applies heat and pressure to the recording medium P, which passes and moves between the heating portion 61 and the pressure roller 62, and fixes the non-fixed image of the recording medium P on the recording medium P.

The discharging unit 70 discharges the recording medium P, which has passed through the fusing unit 60, to the outside of the image forming apparatus 1. The discharging unit 70 may include a discharge roller 71 and a discharge backup roller 72 installed against the discharge roller 71.

Figure 2:
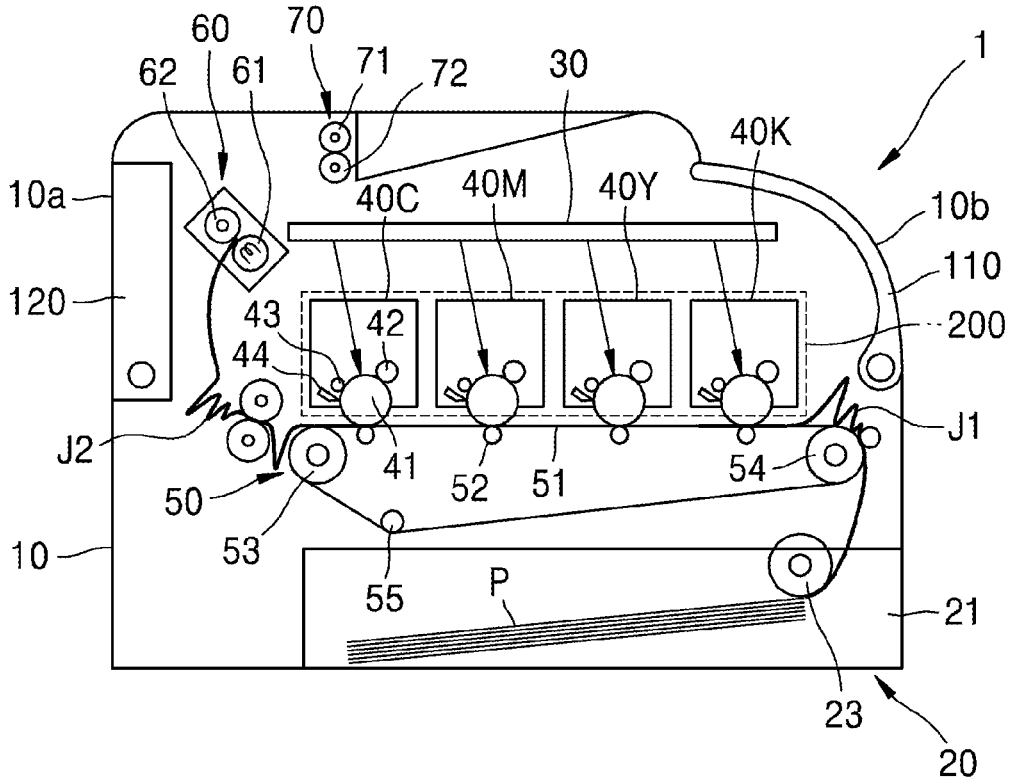
FIG. 2 illustrates an exemplary occurrence of a jam in an image forming apparatus.

FIG. 2 illustrates an exemplary occurrence of a jam in an image forming apparatus 1.

Referring to FIG. 2, in the image forming apparatus 1, a recording medium P may be stuck, that is, a jam may occur, due to the state of the recording medium P, wear of the components installed in the apparatus body 10, etc. in a printing operation in which an image is formed on the recording medium P. For example, when a direct transfer method, in which a visible image formed on the photoconductor 41 is directly transferred to the recording medium P, is selected as the transfer method of the image forming apparatus 1, a recording medium J1 may be stuck in an operation where the recording medium J1 enters or passes an area between the photoconductor 41 and the conveyance belt 51, and a recording medium J2 may be stuck in an operation in which the recording medium J2 passes through the conveyance belt 51 and enters or passes through the fusing unit 60.

In order to resolve the jam, the first door member 110 may be opened so as to remove the recording medium J1, or the second door member 120 may be opened to remove the recording medium J2. A contact between the photoconductor 41 and the conveyance belt 51 needs to be released because if the recording medium J1 or J2 is removed just by opening the first door member 110 or the second door member 120 while the photoconductor 41 and the conveyance belt 51 are in contact, the recording medium J1 or J2 may be torn or the photoconductor 41 or the conveyance belt 51 may be damaged. Thus, in order to remove the recording media J1 and J2 without damage to the photoconductor 41 and the conveyance belt 51, the conveyance belt 51 and the photoconductor 41 need to be separated when removing a jam. A first link unit 111 and a second link unit 121 (see, for example, FIG. 3) of a jam removing device 100 according to an exemplary embodiment of the present invention has a configuration for separating the conveyance belt 51 and the photoconductor 41 when opening the first door member 110 and the second door member 120, respectively.

Figure 3:
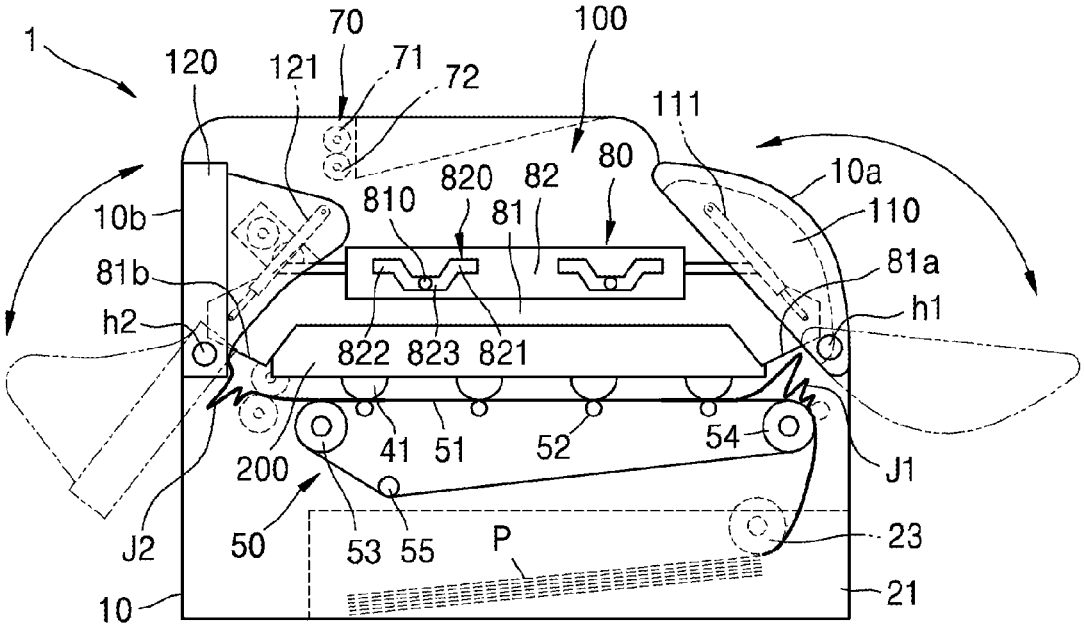
FIG. 3 illustrates an exemplary jam removing device in an image forming apparatus according to an exemplary embodiment of the present invention.
Figure 4:
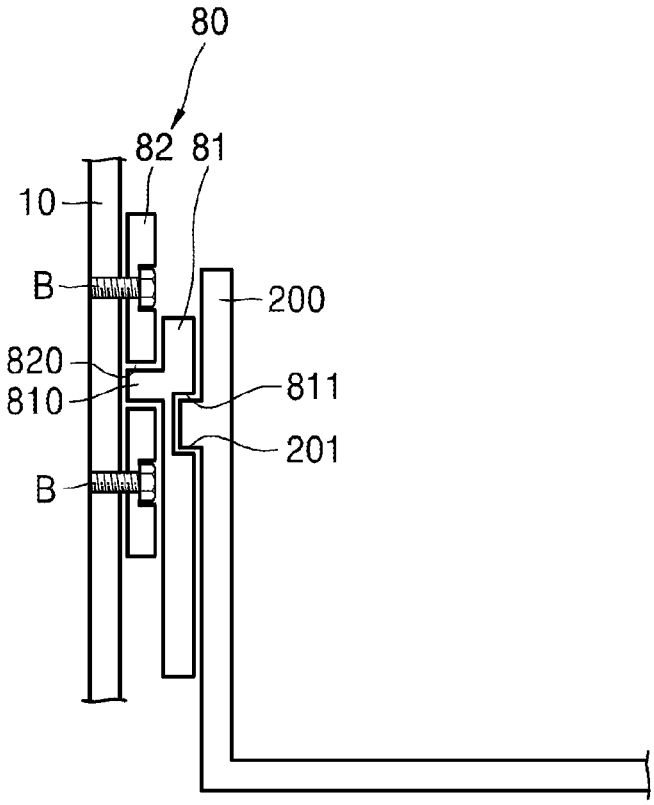
FIG. 4 illustrates an exemplary guide unit of according to an exemplary embodiment of the present invention.

FIG. 3 illustrates an exemplary jam removing device 100 in the image forming apparatus 1, according to an exemplary embodiment of the present invention. FIG. 4 illustrates a guide unit 80 of FIG. 3, according to an exemplary embodiment of the present invention. Referring to FIG. 3, the jam removing device 100 may include the guide unit 80 that guides the tray 200 including the developing unit 40, the first and second door members 110 and 120 that are installed in a manner that they may opened or closed with respect to the apparatus body 10, and the first and second link units 111 and 121 that are respectively connected to the first and second door members 110 and 120.

The guide unit 80 may include a first guide 81 and a second guide 82. Referring to FIG. 4, the first guide 81 may guide insertion or withdrawal of the tray 200, and the second guide 82 guides contact or separation of the tray 200 mounted with the developing unit 40 to, or from, the transfer unit 50.

The first guide 81 may be slidably coupled to the tray 200. For example, as illustrated in FIG. 4, a concave portion 811 of the first guide 81 may be slidably coupled to a protrusion 201 of the tray 200. However, the coupling between the first guide 81 and the tray 200 is not limited thereto, alternatively, a protrusion may be formed on the first guide 81, and a concave portion may be formed in the tray 200.

The second guide 82 may be fixed to the apparatus body 10 by using a fixing portion B, and the first guide 81 may be movably supported with respect to the second guide 82. In order that the first guide 81 is movably supported with respect to the second guide 82, one of the first guide 81 and the second guide 82 may include a boss 810 that is protruded, and the other of the first guide 81 and the second guide 82 may have a long hole 820, into which the boss 810 is inserted, so as to guide the boss 810. For example, as illustrated in FIG. 4, the first guide 81 may include the boss 810 that is protruded toward the second guide 82, and the second guide 82 may include the long hole 820, into which the boss 810 is inserted, so as to guide the boss 810. However, the arrangement of the boss 810 and the long hole 820 is not limited thereto. The long hole 820 may be formed in the first guide 81, and the boss 810 may formed on the second guide 82. As the boss 810 moves along the long hole 820, the first guide 81 is guided by the second guide 82. The long hole 820 may be formed in various patterns by which the photoconductor 41 may contact (or approach) the conveyance belt 51 or may be separated from the conveyance belt 51. For example, as illustrated in FIG. 3, the long hole 820 may include a contact portion 823 for bringing the photoconductor 41 into contact with the conveyance belt 51, a first separation portion 821 that is extended from the contact portion 823 so as to separate the photoconductor 41 from the conveyance belt 51, and a second separation portion 822 that is extended in an opposite direction to the first separation portion 821 so as to separate the photoconductor 41 from the conveyance belt 51. The contact portion 823 may be formed between the first separation portion 821 and the second separation portion 822, and to be relatively close to the conveyance belt 51 compared to the first and second separation portions 821 and 822. The first guide 81 may be guided by the second guide 82 as the boss 810 is inserted into the long hole 820 to move between the first separation portion 821, the contact portion 823, and the second separation portion 822.

The first door member 110 may be installed on an in/out path of the tray 200, and may open or close a first side portion of the apparatus body 10. The first door member 110 may be rotated with respect to a hinge axis h1, and may open or close an opening 10*a* formed in the first side portion of the apparatus body 10. By opening the first door member 110, the tray 200 may be inserted or drawn out, and a recording medium J1 stuck inside the apparatus body 10 may be exposed.

The first link unit 111 connects the first door member 110 and the first guide 81. When the first door member 110 is opened or closed, the first guide 81 is linked via the first link unit 111. For example, when the first door member 110 is opened, the boss 810 of the first guide 81 may move from the contact portion 823 of the second guide 82 to the first separation portion 821. As the first guide 81 is moved, the tray 200 that is slidably coupled to the first guide 81 is also moved, and accordingly, the photoconductor 41 of the developing unit 40 and the conveyance belt 51 may be separated from each other. When the first door member 110 is opened, the photoconductor 41 and the conveyance belt 51 may be separated, and thus, it is easy to remove the recording medium J1 that is adjacent to the first door member 110. The first guide 81 may have an inclined surface 81*a* in an area against the hinge axis h1 of the first door member 110. Interference with the hinge axis h1 when the first guide 81 moves may be prevented via the inclined surface 81*a*.

The second door member 120 may be installed in an opposite direction to the first door member 110 in the apparatus body 10, and may open or close a second side of the apparatus body 10. The second door member 120 may be rotated with respect to a hinge axis h2 and may open or close an opening 10*b* formed in the second side of the apparatus body 10. By opening the second door member 120, a recording medium J2 that is far away from the first door member 110, for example, the recording medium J2 that is stuck near the fusing unit 60 (see, for example, FIG. 2), may be exposed.

The second link unit 121 connects the second door member 120 and the first guide 81. When the second door member 120 is opened or closed, the first guide 81 may be linked via the second link unit 121. For example, when the second door member 120 is opened, the boss 810 of the first guide 81 may move from the contact portion 823 of the second guide 82 to the second separation portion 822. As the first guide 81 is moved, the tray 200 that is slidably coupled to the first guide 81 is also moved, and accordingly, the photoconductor 41 mounted in the tray 200 and the conveyance belt 51 may be separated from each other. When the second door member 120 is opened, the photoconductor 41 and the conveyance belt 51 may be separated, and thus, it is easy to remove the recording medium J2 that is adjacent to the second door member 120. The first guide 81 may have an inclined surface 81*b* in an area against the hinge axis h2 of the second door member 120. Interference with the hinge axis h2 when the first guide 81 moves may be prevented via the inclined surface 81*b*.

Figure 5A:
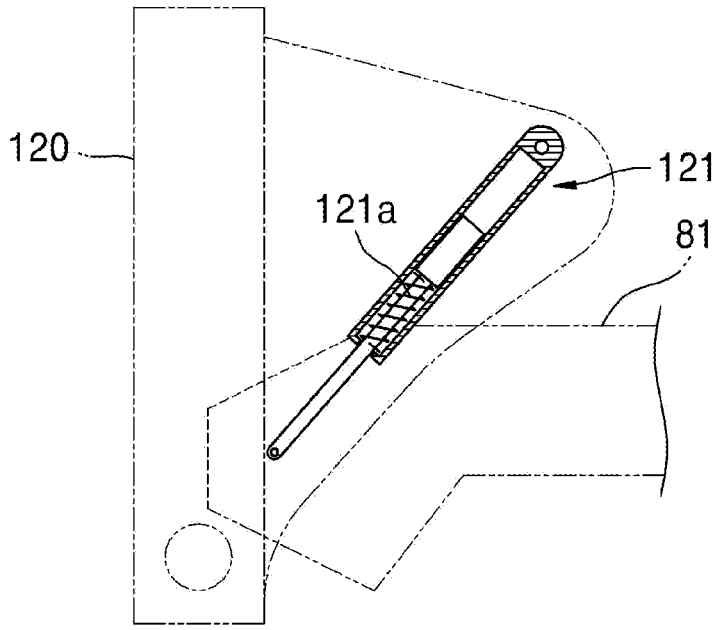
FIGS. 5A and 5B illustrate respectively a first link unit and a second link unit according to an exemplary embodiment of the present invention.
Figure 5B:
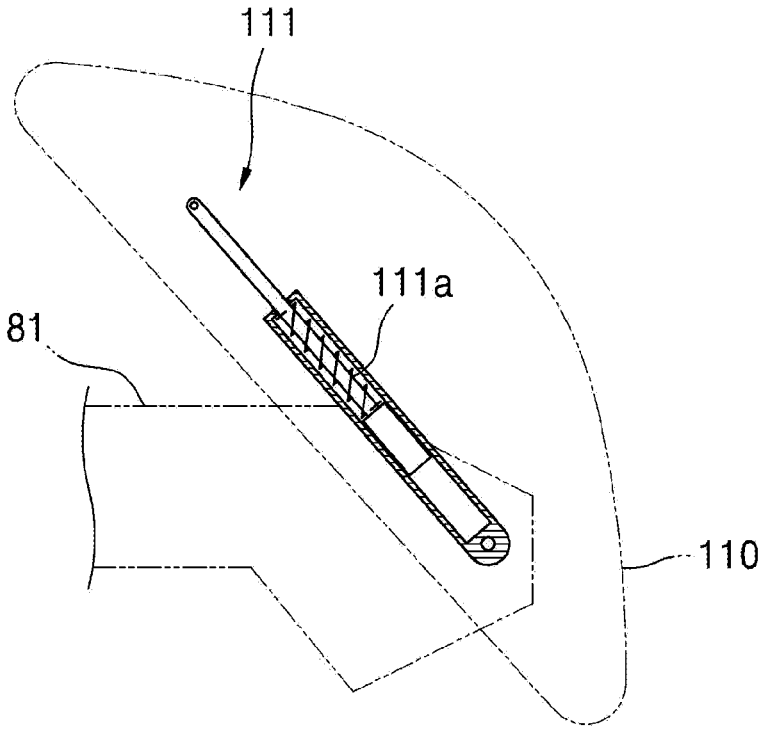

FIGS. 5A and 5B illustrate an exemplary first link unit 111 and second link unit 121, respectively. Referring to FIGS. 5A and 5B, the first link unit 111 and the second link unit 121 may respectively include first and second elastic bodies 111*a* and 121*a*, which are stretchable/contractible in a length direction. A length of the link unit 111 may be adjusted by using tension/contraction of the first elastic body 111*a*. By using the first link unit 111, which is length-variable, a difference in movement distances between the first guide 81 and the first door member 110 may be compensated. By using tension/contraction of the second elastic body 121*a*, a length of the second link unit 121 may be adjusted. By using the second link unit 121, which is length-variable, a difference in movement distances between the first guide 81 and the second door member 120 may be compensated. The first elastic body 111*a* and the second elastic body 111*b* are elastic objects such as a spring or a rubber.

Figures 6A, 6B:
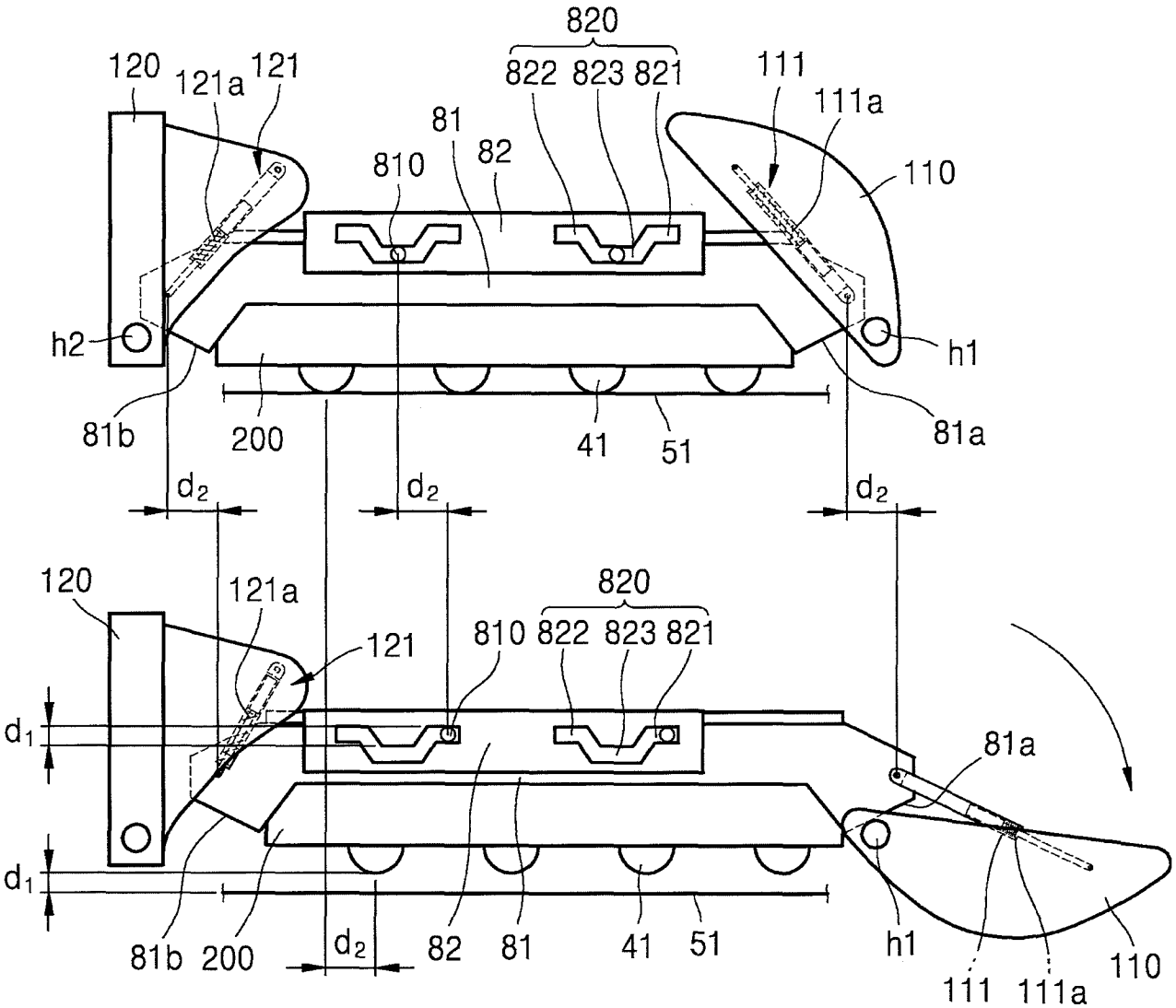
FIGS. 6A-6B and 7A-7B illustrate exemplary operational states of a jam removing device according to an exemplary embodiment of the present general inventive concept.
Figures 7A, 7B:
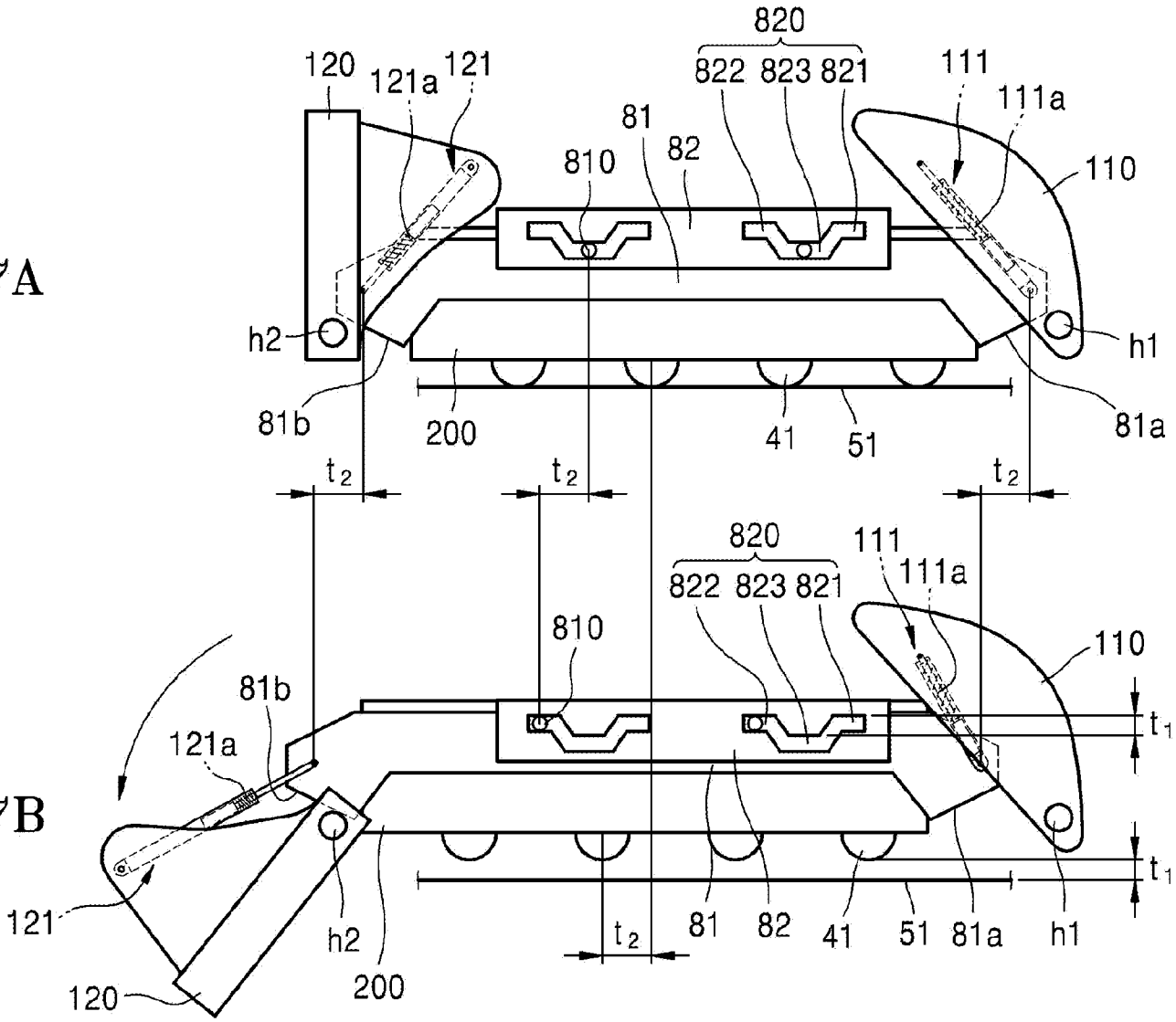

FIGS. 6A, 6B, 7A, and 7B illustrate exemplary operational states of the a jam removing device, for example jam removing device 100 of FIG. 3. FIG. 6A illustrates an exemplary state of the jam removing device 100 when the first door member 110 is closed. FIG. 6B illustrates an exemplary state of the jam removing device 100 when the first door member 110 is opened. FIG. 7A illustrates an exemplary state of the jam removing device 100 when the second door member 120 is closed. FIG. 7B illustrates an exemplary state of the jam removing device 100 when the second door member 120 is opened.

Referring to FIGS. 6A and 6B, when the user opens the first door member 110, the first guide 81 linked with the first door member 110 receives a force in a first direction, which is the direction of the first door member 110. The first guide 81 that receives a force in the first direction may move along the patterns of the long hole 820. The long hole 820 may include the contact portion 823 to bring the photoconductor 41 of the developing unit 40 into contact with the conveyance belt 51 and the first separation portion 821 that is extended from the contact portion 823. As the boss 810 of the first guide 81 moves from the contact portion 823 to the first separation portion 821, the photoconductor 41 and the conveyance belt 51 may be separated to release the contact between the photoconductor 41 and the conveyance belt 51. A distance d1 denotes a difference in a height of the long hole 820 between the contact portion 823 and the first separation portion 821, which is identical to a vertical distance that the first guide 81 moves when the first door member 110 is opened and to a distance whereby the photoconductor 41 is separated from the conveyance belt 51. A distance d2 denotes a horizontal distance that the first guide 81 moves as the first door member 110 is opened.

When the first door member 110 is opened, the second link unit 121 may be stretched or contracted by using the second elastic body 121*a* that is stretchable/contractible. When the first door member 110 is opened while the second door member 120 is closed, the second door member 120 is in a non-rotational state in the apparatus body 10, that is, not moving, and thus may not track the distances d1 and d2 of the first guide 81. As the second link unit 121 connecting the second door member 120 and the first guide 81 is stretched or contracted, the distances d1 and d2 not tracked by the second door member 120 may be compensated. If a rotational distance of the first door member 110 and a movement distance of the first guide 81 vary, the first link unit 111 may be stretched.

When the first door member 110 is closed, the first guide 81 may move in a second direction that is a direction of the second door member 120, so that the photoconductor 41 and the conveyance belt 51 may be in contact.

Referring to FIGS. 7A and 7B, when the user opens the second door member 120, the first guide 81 that is linked with the second door member 120 receives a force in the second direction which is the direction of the second door member 120. The first guide 81, which receives a force in the second direction, moves along the patterns of the long hole 820. The long hole 820 may include the contact portion 823 to bring the photoconductor 41 of the developing unit 40 in contact with the conveyance belt 51 and the second separation portion 822 that is extended from the contact portion 823. As the boss 810 of the first guide 81 moves from the contact portion 823 to the second separation portion 822, the photoconductor 41 and the conveyance belt 51 may be separated to release the contact between the photoconductor 41 and the conveyance belt 51. A distance t1 denotes a difference in a height of the long hole 820 between the contact portion 823 and the second separation portion 822, and is identical to a vertical distance that the first guide 81 moves when the second door member 120 is opened, and to a distance whereby the photoconductor 41 is separated from the conveyance belt 51. A distance t2 denotes a horizontal distance that the first guide 81 moves as the second door member 120 is opened.

When the second door member 120 is opened, the first link unit 111 may be stretched or contracted by using the first elastic body 111*a* that is stretchable/contractible. When the second door member 120 is opened while the first door member 110 is closed, the first door member 110 is in a non-rotational state in the apparatus body 10, that is, not moving, and thus may not track the distances t1 and t2 of the first guide 81. As the first link unit 111 connecting the first door member 110 and the first guide 81 is stretched or contracted, the distances t1 and t2 not tracked by the first door member 110 may be compensated. If the rotational distance of the second door member 120 and the movement distance of the first guide 81 vary, the second link unit 121 may be stretched.

When the second door member 120 is closed, the first guide 81 may move in the first direction, which is a direction of the first door member 110, so that the photoconductor 41 and the conveyance belt 51 may be in contact.

According to an exemplary embodiment of the jam removing device, the image forming apparatus including the jam removing device, and the method of removing a jam of the exemplary embodiments of the present invention, first and second door members installed respectively at each of two sides of an apparatus body and a developing unit may be linked with each other such that when either the first or second door member is opened, the developing unit may be separated from the transfer unit so that a recording medium stuck between the developing unit and the transfer unit may be easily removed from the two sides of the apparatus body.

While the present invention has been particularly shown and described with reference to exemplary embodiments thereof, the exemplary embodiments should be considered in descriptive sense only and not for purposes of limitation. For example, while the image forming apparatus which forms color images by using toners of cyan (C), magenta (M), yellow (Y), and black (K) colors is described, the prevent invention is not limited thereto. The image forming apparatus may use other various methods such as by using a single-color toner. Although a direct transfer method is described, the present invention is not limited thereto, and other intermediate transfer methods such as a method using an intermediate transfer belt (ITB) may also be used. Moreover, it will be understood by one of ordinary skill in the art that various changes and alternative equivalents may be made in place of the exemplary embodiments of the present invention.

What is claimed is:

1. A jam removing device comprising:

a first door member that is installed on an in/out path of a tray mounted with a developing unit and is opened or closed with respect to an apparatus body;

a second door member that is installed in the apparatus body in an opposite direction to the first door member and is opened or closed with respect to the apparatus body;

a guide unit comprising a first guide that guides an insertion/withdrawal of the tray with respect to the apparatus body and a second guide that guides the first guide in such a manner that the developing unit approaches or separates from a transfer unit;

a first link unit connecting the first door member and the first guide; and a second link unit connecting the second door member and the first guide, wherein when the first door member is opened or closed, the first guide is guided by the second guide to move in a direction where the developing unit approaches or separates from the transfer unit, and when the second door member is opened or closed, the first guide is guided by the second guide to move in a direction where the developing unit approaches or separates from the transfer unit, wherein the first link unit and the second link unit each comprise an elastic body that is stretchable/contractible in a length direction, wherein when one door member of the first and second door members is opened and the other door member of the first and second door members is not opened, a length of a corresponding link unit from among the first and second link units that connects the other door member of the first and second door members, which is not opened, and the first guide is adjusted.

2. The jam removing device of claim 1, wherein the first guide comprises a protruded boss, and the second guide includes a long hole, into which the boss is inserted, so as to guide the boss.

3. A jam removing device comprising:

a first door member that is installed on an in/out path of a tray mounted with a developing unit and is opened or closed with respect to an apparatus body;

a second door member that is installed in the apparatus body in an opposite direction to the first door member and is opened or closed with respect to the apparatus body;

a guide unit comprising a first guide that guides an insertion/withdrawal of the tray with respect to the apparatus body and a second guide that guides the first guide in such a manner that the developing unit approaches or separates from a transfer unit;

a first link unit connecting the first door member and the first guide; and a second link unit connecting the second door member and the first guide, wherein when the first door member is opened or closed, the first guide is guided by the second guide to move in a direction where the developing unit approaches or separates from the transfer unit, and when the second door member is opened or closed, the first guide is guided by the second guide to move in a direction where the developing unit approaches or separates from the transfer unit, wherein when one door member of the first and second door members is opened and the other door member of the first and second door members is not opened, a length of a corresponding link unit from among the first and second link units that connects the other door member of the first and second door members, which is not opened, and the first guide is adjusted.

4. The jam removing device of claim 3, wherein when one door member of the first and second door members is opened, a corresponding link unit from among the first and second link units that connects the one door member of the first and second door members and the first guide is stretched.

5. A jam removing device comprising:

a first door member that is installed on an in/out path of a tray mounted with a developing unit and is opened or closed with respect to an apparatus body;

a second door member that is installed in the apparatus body in an opposite direction to the first door member and is opened or closed with respect to the apparatus body;

a guide unit comprising a first guide that guides an insertion/withdrawal of the tray with respect to the apparatus body and a second guide that guides the first guide in such a manner that the developing unit approaches or separates from a transfer unit;

a first link unit connecting the first door member and the first guide; and a second link unit connecting the second door member and the first guide, wherein when the first door member is opened or closed, the first guide is guided by the second guide to move in a direction where the developing unit approaches or separates from the transfer unit, and when the second door member is opened or closed, the first guide is guided by the second guide to move in a direction where the developing unit approaches or separates from the transfer unit, wherein the first guide comprises a protruded boss, and the second guide includes a long hole, into which the boss is inserted, so as to guide the boss, wherein the long hole comprises:

a contact portion to allow the developing unit to contact the transfer unit, a first separation portion that is extended from the contact portion and via which the developing unit is separated from the transfer unit, and a second separation portion that is extended from the contact, portion in an opposite direction to the first separation portion and via which the developing unit is separated from the transfer unit.

6. The jam removing device of claim 5, wherein when the first door member is opened, the boss is located at the first separation portion.

7. The jam removing device of claim 5, wherein the second door member is opened, the boss is located the second separation portion.

8. The jam removing device of claim 5, wherein when the first door member or the second door member is closed, the boss is located at the contact portion.

9. An image forming apparatus in which a developing unit for forming a visible image is detachably coupled to an apparatus body, comprising:

a tray that is mounted with the developing unit and is installed in a manner that the tray may enter and exit the apparatus body;

a transfer unit transferring a visible image formed by using the developing unit to a recording medium; and a jam removing device comprising:

a first door member that is installed on an in/out path of the tray and is opened or closed with respect to the apparatus body, a second door member that is installed in the apparatus body in an opposite direction to the first door member and is opened or closed with respect to the apparatus body;

a guide unit comprising a first guide that guides insertion/withdrawal of the tray with respect to the apparatus body and a second guide that guides the first guide in such a manner that the developing unit approaches or separates from a transfer unit, a first link unit connecting the first door member and the first guide, and a second link unit connecting the second door member and the first guide, wherein when the first door member is opened or closed, the first guide is guided by the second guide to move in a direction where the developing unit approaches or separates from the transfer unit, and when the second door member is opened or closed, the first guide is guided by the second guide to move in a direction where the developing unit approaches or separates from the transfer unit, wherein the first link unit and the second link unit each comprise an elastic body that is stretchable/contractible in a length direction, wherein when one door member of the first and second door members is opened and the other door member of the first and second door members is not opened, a length of a corresponding link unit from among the first and second link units that connects the other door member of the first and second door members, which is not opened, and the first guide is adjusted.

10. The image forming apparatus of claim 9, wherein the first guide comprises a protruded boss, and the second guide has a long hole, into which the boss is inserted, so as to guide the boss.

11. An image forming apparatus in which a developing unit for forming a visible image is detachably coupled to an apparatus body, comprising:

a tray that is mounted with the developing unit and is installed in a manner that the tray may enter and exit the apparatus body;

a transfer unit transferring a visible image formed by using the developing unit to a recording medium; and a jam removing device comprising:

a first door member that is installed on an in/out path of the tray and is opened or closed with respect to the apparatus body, a second door member that is installed in the apparatus body in an opposite direction to the first door member and is opened or closed with respect to the apparatus body;

a guide unit comprising a first guide that guides insertion/withdrawal of the tray with respect to the apparatus body and a second guide that guides the first guide in such a manner that the developing unit approaches or separates from a transfer unit, a first link unit connecting the first door member and the first guide, and a second link unit connecting the second door member and the first guide, wherein when the first door member is opened or closed, the first guide is guided by the second guide to move in a direction where the developing unit approaches or separates from the transfer unit, and when the second door member is opened or closed, the first guide is guided by the second guide to move in a direction where the developing unit approaches or separates from the transfer unit, wherein when one door member of the first and second door members is opened and the other door member of the first and second door members is not opened, a length of a corresponding link unit from among the first and second link units which connects the other door member of the first and second door members, which is not opened, and the first guide is adjusted.

12. The image forming apparatus of claim 11, wherein when one door member of the first and second door members is opened, a corresponding link unit from among the first and second link units that connects the one door member from among the first and second door members and the first guide is stretched.

13. An image forming apparatus in which a developing unit for forming a visible image is detachably coupled to an apparatus body, comprising:

a tray that is mounted with the developing unit and is installed in a manner that the tray may enter and exit the apparatus body;

a transfer unit transferring a visible image formed by using the developing unit to a recording medium; and a jam removing device comprising:

a first door member that is installed on an in/out path of the tray and is opened or closed with respect to the apparatus body, a second door member that is installed in the apparatus body in an opposite direction to the first door member and is opened or closed with respect to the apparatus body;

a guide unit comprising a first guide that guides insertion/withdrawal of the tray with respect to the apparatus body and a second guide that guides the first guide in such a manner that the developing unit approaches or separates from a transfer unit, a first link unit connecting the first door member and the first guide, and a second link unit connecting the second door member and the first guide, wherein when the first door member is opened or closed, the first guide is guided by the second guide to move in a direction where the developing unit approaches or separates from the transfer unit, and when the second door member is opened or closed, the first guide is guided by the second guide to move in a direction where the developing unit approaches or separates from the transfer unit, wherein the first guide comprises a protruded boss, and the second guide has a long hole, into which the boss is inserted, so as to guide the boss, wherein the long hole comprises:

a contact portion via which the developing unit contacts the transfer unit, a first separation portion that is extended from the contact portion and via which the developing unit is separated from the transfer unit, and a second separation portion that is extended from the contact portion in an opposite direction to the first separation portion and via which the developing unit is separated from the transfer unit.

14. The image forming apparatus of claim 13, wherein when the first door member is opened, the boss is located at the first separation portion.

15. The image forming apparatus of claim 13, wherein the second door member is opened, the boss is located at the second separation portion.

16. The image forming apparatus of claim 13, wherein when the first door member or the second door member is closed, the boss is located at the contact portion.

17. A method of removing a jam, the method comprising:

preparing a jam removing device comprising first and second door members that are installed respectively at each of two sides of an apparatus body to open or close the apparatus body, a first guide guiding insertion and withdrawal of a tray mounted with a developing unit, a second guide guiding the first guide to separate from the transfer unit, and first and second link units respectively connecting the first and second door members and the first guide;

moving the first guide along the second guide by opening the first door member;

separating the tray from the transfer unit by using the first guide; and separating the developing unit from the transfer unit, wherein when the first door member is opened or closed, the first guide is guided by the second guide to move in a direction where the developing unit approaches or separates from the transfer unit, and when the second door member is opened or closed, the first guide is guided by the second guide to move in a direction where the developing unit approaches or separates from the transfer unit, wherein the first link unit and the second link unit each comprise an elastic body that is stretchable/contractible in a length direction, wherein when one door member of the first and second door members is opened and the other door member of the first and second door members is not opened, a length of a corresponding link unit from among the first and second link units that connects the other door member of the first and second door members, which is not opened, and the first guide is adjusted.

18. The method of claim 17, further comprising:

moving the first guide along the second guide by opening the second door member;

separating the tray from the transfer unit by using the first guide; and separating the developing unit from the transfer unit.

19. The method of claim 17, wherein the tray is drawn from the apparatus body while the first door member is opened.

* * * * *

UNITED STATES PATENT AND TRADEMARK OFFICE

CERTIFICATE OF CORRECTION

PATENT NO. : 9,152,123 B2
APPLICATION NO. : 13/953154
DATED : October 6, 2015
INVENTOR(S) : Jeong-yeon Park et al.

It is certified that error appears in the above-identified patent and that said Letters Patent is hereby corrected as shown below:

In the Claims

Claim 5, Column 10, Line 45

Delete “contact,” and insert --contact--, therefor.

Claim 7, Column 10, Line 63

After “located” insert --at--.

Signed and Sealed this
Ninth Day of February, 2016

Michelle K. Lee

Michelle K. Lee
*Director of the United States Patent and Trademark Office*